United States Patent [19]

Mayhew

[11] 3,942,989

[45] Mar. 9, 1976

[54] WHITE RUST PREVENTION FOR ZINC COATED SURFACES

[76] Inventor: John T. Mayhew, Box 156, Sunset Drive, Toronto, Ohio 43964

[22] Filed: June 15, 1972

[21] Appl. No.: 263,317

Related U.S. Application Data

[63] Continuation-in-part of Ser. No. 83,003, Oct. 22, 1970, abandoned.

[30] Foreign Application Priority Data

Sept. 13, 1971 Japan ..... 46-70471

[52] U.S. Cl. ..... 106/14; 427/404; 148/6.2; 252/396

[51] Int. Cl.[2] ..... C09D 5/08

[58] Field of Search ..... 148/6.2, 6.14 A; 106/14; 117/127; 252/396

[56] References Cited

UNITED STATES PATENTS

| | | | |
|---|---|---|---|
| 2,434,525 | 1/1948 | Thomas et al. | 148/6.2 |
| 2,559,812 | 7/1951 | Watson | 148/6.2 |
| 2,768,103 | 10/1956 | Schuster et al. | 148/6.2 |
| 2,911,332 | 11/1959 | Schuster et al. | 148/6.2 |
| 2,991,205 | 7/1961 | Lincoln et al. | 148/6.2 |
| 3,421,949 | 1/1969 | Halverson | 148/6.2 |
| 3,706,603 | 12/1972 | Vessey et al. | 148/6.2 |

*Primary Examiner*—Lorenzo B. Hayes

*Attorney, Agent, or Firm*—Parmelee, Miller, Welsh & Kratz

[57] ABSTRACT

A hot galvanized strip, plate or other ferrous metal workpiece is moved continuously from a cooling tower, and while at a temperature within a range of about 130° to 180° F. its zinc coating surfaces are subjected to the application of a white rust inhibiting master aqueous chemical treating solution. The solution forms a substantially transparent protective film on the coating surfaces that is adherent thereto. The solution contains the compounds and reaction products of two solutions as mixed together, one of which is made up of sodium dichromate dissolved in and reacted with ethylene glycol and the other of which is made of potassium dichromate dissolved in and reacted with ethylene glycol.

10 Claims, 1 Drawing Figure

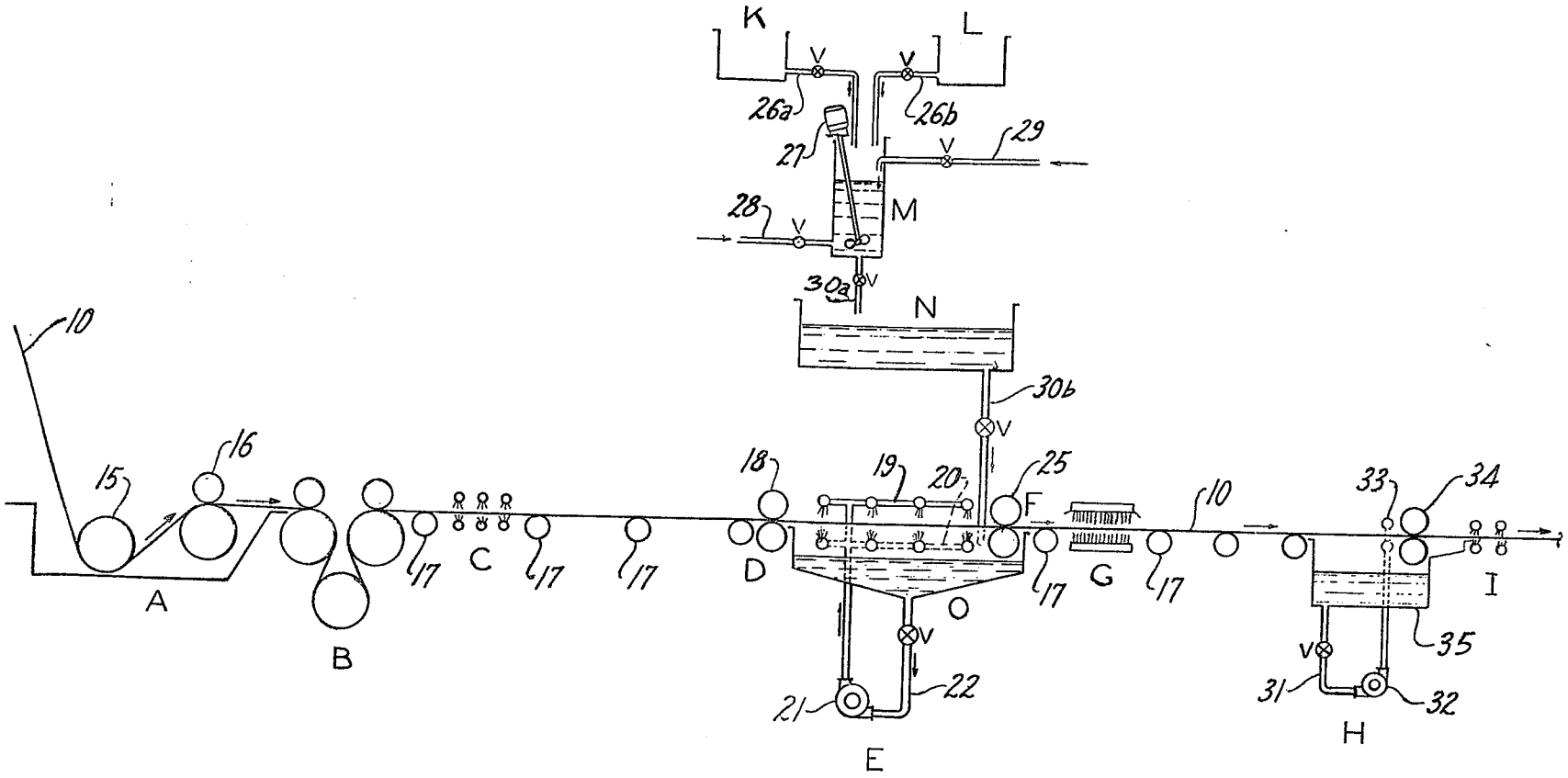
10
15
16
A
B
C
17
17
17
17
17
D
18
19
20
O
E
21
22
F
25
G
10
H
31
32
33
34
35
I
K
L
26a
26b
27
28
29
M
30a
N
30b
V

WHITE RUST PREVENTION FOR ZINC COATED SURFACES

CROSS-REFERENCE TO RELATED APPLICATION

This is a continuation-in-part of my application Ser. No. 83,003, filed Oct. 22, 1970 and entitled "White Rust Prevention for Zinc Coated Surfaces," now abandoned.

BACKGROUND OF THE INVENTION

1. Field of the Invention

This invention deals with the problem of producing or providing galvanized metal that is at least substantially free of so-called white rust and particularly, to preventing the forming of zinc hydroxide and zinc carbonate in the presence of moisture on zinc coated surfaces of ferrous metal members or workpieces. A phase of the invention deals with providing an improved surface treating solution for the zinc coating of galvanized ferrous metal workpieces that will eliminate the disadvantageous features and limitations of prior mixtures or treatment solutions.

2. Description of the Prior Art

Although the formation of zinc oxide is desirable from the standpoint of providing a protective film or surface, the formation of zinc hydroxide and zinc carbonate is highly disadvantageous. The latter zinc compounds are the reaction products of moisture with a zinc coating, and may result in a complete eating-through of the coating to the ferrous metal surface thus exposing it to corrosion. The ability of galvanized members to resist white rusting is tested by the industry with a so-called stack test in which 12 × 12 inch square are cut and held for 24 hours, and are thereafter sprayed with distilled water while they are being piled up in a stack. A weight is then placed on top of the stack to press the members down tightly. After six days the specimens are examined for white rust. If there is less than 10%, the results have heretofore been considered good. This rust has a somewhat grayish, light blue or milky appearance and, in this respect, is also disadvantageous from the standpoint of spoiling the surface appearance of metal members.

Since the primary function of a zinc coating on metal sheets or coils is to protect the ferrous metal, steel or iron base metal, and since the members may be subjected to rain or moisture from the ambient atmosphere, white rusting is a definite problem in the art, particularly while in a lift (pile of sheets) or in coil form. In fact, it will appear within a few hours after wetting when specimens are stacked for testing, and the severity of the attack increases with time. The industry has endeavored to limit or control the formation of white rust by the application of oils or chromate treatment materials, such as represented by the trademarked products, Chronak, Iridite or Zinodine. Such treatments will tend to minimize white rust but they also tend to discolor the zinc coatings. Films produced by chromated proteins also have the same characteristics as far as coated surfaces are concerned. Soluble resins have been tried by those skilled in the art but have not been satisfactory in that they tend to prevent normal galvanic action and to lock in and pick up moisture.

The problem has been complicated by endeavoring to find some solution or treatment which will not only do a better job from the standpoint of eliminating white rust, but importantly, that will not destroy desirable, normal galvanic action between the zinc and the ferrous metal base portion of the member. The problem also involves devising a treatment solution which will provide an adherent substantially transparent film on the metal surface, will not discolor it, and will permit zinc oxidation formation. I have been able to effectively solve the problem and meet all the factors involved by the creation of a master treating solution which has the further characteristic of fully resisting contamination under conditions of reuse, such as represented by particles of iron and zinc that are picked up from the carry-over on the strip or workpieces being treated and from metal bath containers. The master solution, unlike the abovementioned chromate types of solutions, does not have to be discarded after a percentage of iron or zinc pick-up has resulted, but may be used indefinitely by merely maintaining its strength or invigorating it from the standpoint of adding additional master solution of the invention thereto. The solution of the invention may be applied continuously to progressively advancing workpieces or portions of a galvanized metal strip of a production line.

SUMMARY OF THE INVENTION

Briefly summarized, the master operating or processing solution of the invention is made up by mixing sodium dichromate in ethylene glycol in one solution batch and separately mixing potassium dichromate in ethylene glycol in a second other batch. Care is taken to avoid an excess of the dichromates in each solution batch and to only supply them in a sufficient amount to substantially fully react with the glycol and, in combination with water, to provide a substantially saturated solution. The substantially saturated solution batches may then be mixed. Water added in controlled amounts to the mixed solution does not adversely affect the results obtained and enables an economical employment of the active chemical content of each batch. The reaction products and chemicals for each batch when mixed may be agitated together and diluted using, as an optimum, about 50% by volume of water, to provide a final or master solution for application to the workpiece. Application of the master solution may be made with the solution in a cold condition (below room temperature), at room temperature or preferably at an elevated temperature, since the solution is to be dried on the workpiece. The drying may be accomplished by elevating the workpiece to a temperature within a range of about 130° to 200° F, and an optimum of about 180° F. A transparent or invisible protective film is provided on the surface which adheres thereto even when hot washing and drying of the workpiece are thereafter accomplished.

It has thus been an object of the invention to devise a solution to the problem heretofore involved in the metal working art from the standpoint of producing galvanized workpieces, members or strips that will have a maximum life under normal atmospheric conditions and that will be inherently protected from the standpoint of the development of white rust.

Another object of the invention has been to meet all the individual and interlocking factors involved in producing a galvanized member that will be capable of conventional galvanic action and, at the same time, will resist the formation of white rust.

A further object of the invention has been to develop a continuous in-line process for effectively and efficiently treating galvanized ferrous metal workpieces without discoloring their surfaces and, in such a manner, as to provide the surfaces with a substantially invisible protective film.

These and other objects of the invention will appear to those skilled in the art from the illustrated embodiment and the claims.

BRIEF DESCRIPTION OF THE DRAWING

The drawing represents a somewhat schematic integrated operating system illustrating a treatment line and process developed in accordance with the invention and utilizing a treatment solution of the invention.

DESCRIPTION OF THE PREFERRED EMBODIMENT

Referring to the drawing, a continuous metal strip or workpiece 10 is shown as continuously advancing downwardly from a cooling tower subsequent to the application of a galvanized coating thereto as by a hot dip operation, and as entering a wash water tank at station A where it is guided under a guide roll 15 through a tension roll pass 16 and is then interleaved through a roll stand B having driven rolls forming a tension bridle. The strip or workpiece 10 then moves through station C at which hot air may be applied to its opposite surfaces for fully drying it before it is moved along a series of longitudinally spaced-apart guide rolls 17 to a pinch roll pass 18 before entering station E. Station E is the main or solution treating station and, as shown, employs a spaced-apart pair of upper and lower spray head assemblies 19 and 20 which simultaneously apply the master solution in spray form to the upper and lower coating surfaces of the workpiece 10 as it progresses through station E. At the exit end of station E, a pair of wringer rolls 25 of station F having a somewhat mat-like finish are employed to preliminarily remove or wipe-off any excess or surplus solution before the workpiece is advanced further along the line.

With particular reference to station E, sodium dichromate and ethylene glycol are mixed and reacted in tank or bath K and, in a like manner, potassium dichromate and ethylene glycol are mixed and reacted in individual tank or bath L. The reacted solutions are then passed downwardly through gravity flow lines **26*a* and 26*b*, past two-way valves V, into a mixing and reacting tank or bath M which is shown provided with an electrically operated mixer 27 and as having an air supply line 28 controlled by a valve V therein. Water to dilute the solution may be introduced through line 29. The reacted mixed final master solution is then moved by gravity through pipe line 30*a* into an overhead hold or supply tank or bath N which may, for example, have a 100 to 150 gallon capacity to contain the master solution. Replenishing solution as needed is taken-off through line 30*b* and collected along with drop-off from the spray assemblies 19 and 20 in a reservoir or tank O. It will be noted that the liquid in tank O is passed downwardly through pipe line 22 and then forced under positive pressure upwardly outwardly from the spray assemblies 19 and 20 by means of an electric motor driven pump 21. The valve V of the line 30*b* will normally be closed, but may be opened from time to time to replenish the solution in the tank O as it is used-up by portions being carried as dragout on the strip 10.**

The workpiece or strip 10, after being treated with the solution at station E and after having moved through the pass of station F, is then moved into and through a dry heat applying station G which may use an infrared heating or baking oven, but which for economy will preferably employ a gas fired burner assembly, such as sold by Equipment Engineering Company of Sheffield Street, Pittsburgh, Pa. At station G, a master solution film is dried-on and adhered to surfaces of the workpiece or strip 10; a temperature of about 130° to 200° F is satisfactory with an optimum of about 180° F. Station G serves to both aid in first fully wetting the surfaces of the workpieces with the sprayed-on solution and for thereafter drying the solution thereon. The workpiece 10 or strip then moves along the rolls 17 to a hot water rinse or washing station H. Hot water tank 35 supplies water at a temperature of about 160° to 200° F through pipe line 31 and motor driven pump 32 to a pair of upper and lower spray heads 33, immediately before the strip 10 moves through a pass defined by a pair of wringer rolls 34 which may have a smooth surface finish. Thereafter, the strip 10 moves through a pass defined by a pair of wringer rolls 34 which may have a smooth finish. Thereafter, the strip 10 may be dried by hot air headers at station I before it is coiled or cut to suitable lengths for storage and shipment. The heat imparted to the workpiece facilitates straightening or bending it and particularly, if it is of heavier gauge.

The steel mills, previous to the present invention, due to the unsatisfactory nature of the previously mentioned solutions, adopted a treatment which makes use of a solution containing borax, sodium chromate, and trisodium phosphate or, in other words, a mixture of salts. There appears to be no chemical reaction between the ingredients of this mixture, but it does have some favorable effect in minimizing the formation of the white rust. In addition to its somewhat limited effectiveness as applied, evaporation of the solution on the workpiece results in the formation of crystals. Evaporation of the solution of the invention, however, results in a somewhat greasylike precipitate which cannot damage the workpiece and which serves as a lubricant. Although it has heretofore been usual to control the pH of the water as used, it has been determined that using the master solution of the invention, it is immaterial whether river water, distilled water or city water is used.

By way of testing, workpieces have also been treated with the individual solution prepared in bath K alone, or, in other words, a solution containing sodium dichromate dissolved and reacted in ethylene glycol. Although it did provide a fair resistance to white rust, after a period of time a cloudiness developed in the film which was adherent to the workpiece. However, the master solution made up of the batches from K and L is substantially 100% effective in preventing the formation of white rust and cloudiness of the film does not develop as when the solution of bath K was used alone.

Another disadvantage of prior solutions has been that they tend to form a sludge which has to be removed and disposed of and also, as previously indicated in view of the fact that they become inoperative after the concentration of iron reaches an adverse amount. As contrasted to this, the solution of the present invention forms no sludge even in the presence of iron or zinc contamination and, in fact, is not adversely affected in any way of heavy concentrations of these two metals. It is interesting to note that although the master solution is applied at station E to the strip or workpiece 10 which has a temperature of about 130° to 180° F, a subsequent application of wash water at station H at a temperature within a range of 160° to 200° F does not damage or remove the protective film which remains in an adherent relation on the strip.

In preparing the solution in bath K, a sufficient amount of ethylene glycol is introduced (in stoichiometric amount) to fully react with the sodium dichromate salt, with a slight excess to assure a full or complete reaction of the salt. The same is true as to the potassium dichromate salt which is reacted in the tank or bath L. The concentrated solutions from the two baths K and L, including the reaction products, may then be introduced into the tank or bath M and there consolidated and mixed. Meticulous research and testing has indicated that the reaction occurring in vat or tank K is represented by the following formula:

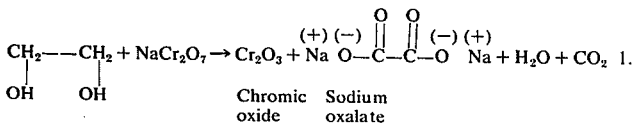

1.

By the same token, it has been determined that the reaction which occurs in tank or vat L is represented by the following formula:

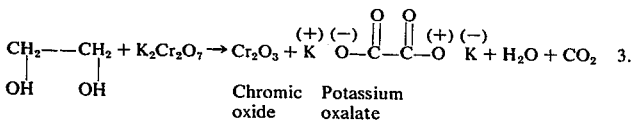

3.

After solutions 1 and 2 are mixed in bath or tank M in substantially equal amounts or proportions from the standpoint of their respective original glycol contents, oxalic acid ($HOOCCOOH.2H_2O$) is formed by the reaction of the two oxalates.

It is important in carrying out the invention to prepare the two dichromate solutions separately. In each solution, the first step involves adding the sodium and the potassium dichromates and reacting each of them with ethylene glycol. From a practical standpoint, the next step involves adding water at a temperature of about 130° to 160° F to the sodium and potassium dichromate somewhat pastelike solutions, and in providing two concentrated, substantially saturated aqueous fluidlike, liquid solutions. It has been determined that a ratio of gram content of the sodium dichromate to the milliliter content of the glycol should be maintained at about 4 to 1 in the first solution, and that a ratio of gram content of potassium dichromate to the milliliter content of glycol in the second solution should be maintained at about 5 to 1. Although it is possible to add water, for example, at room temperature to each of the solutions, it has been determined that from a practical standpoint, the water should be added in a heated condition to quickly attain a solution in each instance that is substantially saturated and in which its dissoluble chemical content has been substantially fully dissolved. The heat also promotes reduction of the valance of the chromium content in each solution.

It has been found that the amount of water to be added for dissolving the chemical content in each solution is slightly greater from the standpoint of the second or potassium solution. That is, a ratio of milliliter amount of water to be added with respect to the milliliter content of the previously added glycol should be maintained at about 1 to 6 in the first or sodium containing solution and about 1 to 9 in the second or potassium containing solution. After the two solutions have been separately prepared in the above manner within, for example, tanks K and L of the drawing, they may be then moved into the mixing tank M. The quantity or volume of each solution as thus mixed will be substantially the same. For example, if, as an optimum, the No. 1 solution is made up utilizing 21 grams of sodium dichromate, 5 milliliters of ethylene glycol and 30 milliliters of water, and the second solution is made up of 25 grams of potassium dichromate, 5 milliliters of ethylene glycol and 45 milliliters of water, the thus specified full content of each would be mixed to produce the solution of tank M.

Although the mixed solution may be directly applied to the workpiece 10 without diluting it, or in its substantially concentrated form, this is uneconomical and, from a practical standpoint, it has been determined that the addition of about 25% to 75% by volume of water will provide a fully effective treating solution from the standpoint of so-called white rust or its equivalent. Such a range or percentage of water dilution is desirable, assuming a speed of workpiece in a normal range of about 300 feet to 600 feet per minute.

From the above, it will appear that the proportioning of the two preliminary solutions is somewhat critical and that both are used in sufficient concentrations or amounts from the standpoint of providing an effective white rust resisting master solution that is applied to and forms a thin, adhering film on zinc coated surface on a ferrous metal workpiece. The use of both solutions in combination, is highly important from the standpoint of avoiding cloudiness, such as occurs when, as previously pointed out, a sodium solution is used alone. The potassium solution requires a slightly greater amount of water. Although the two separate solutions have substantially the same volume content, the potassium solution has a slightly greater amount of potassium dichromate with respect to glycol as compared to the sodium dichromate solution, and the potassium dichromate solution requires a slightly greater amount of water or about 1.5 times the quantity required for the first or sodium solution with which it is to be mixed. In each instance, the desiratum has been to provide an aqueous substantially saturated solution, with the dichromates constituting the major ingredient introduced thereto.

The master solution of the present invention has also been found to act as an excellent corrosion preventative for a metal such as aluminum. This is particularly important since it is customary in the art to use about 0.10 to 0.30% aluminum in a galvanizing melt. It appears that the oxalic acid and chromic oxide are major ingredients in the protective coating provided by the solution. It is of interest to note that potassium and sodium oxalates as well as oxalic acid are fully soluble in water while the chromic oxide is insoluble and is maintained in suspension in the solution as applied.

Another characteristic of the solution is the fact that the by-products are coated-out in substantially transparent form as the solution is applied to a progressively advancing workpiece 10. There is no need to sludge-out the solution after it has been in use for some time. The potassium dichromate solution not only supplements the action of the sodium dichromate solution to substantially fully inhibit the formation of white rust on the surface of the workpiece, but it additionally has the function of inhibiting staining of the workpieces. The effectiveness of the solution has been exemplified using the above mentioned optimum contents for the primary solutions and about a 50% by volume water content in the master solution, by conducting a conventional stack test on 12 × 12 inch specimens of a galvanized ferrous metal workpiece as subjected to the solution treatment of the invention. There was not a trace of wet storage stain. The specimens were then hung outside and exposed to the weather for a period of about two months and were found to have gradually oxidized uniformly without any evidence of white rust stains. The specimens were then taken down and again given a conventional stack test without a trace of wet storage stains. This testing not only proved the effectiveness of the master solution, but also the fact that it, in no sense, adversely affects normal galvanic action wherein the zinc coating oxidizes and provides a protective surface.

By way of example, employing the layout of the drawing, water may be added through line 29 to the tank M. The tank N which is the holding tank may, for example, have a capacity of about 100 to 150 gallons collecting tank O a capacity of about 300 to 400 gallons. Again referring to the drawing, the strip or workpiece 10, on leaving station F moves through the dry heat applying station G at which the solution is baked on and adhered to its opposite zinc coating surfaces prior to the hot water wash at station H. After moving through the pass of wringer rolls 34, the workpiece 10 is then subjected to a drying hot air application to its opposite surfaces at station I.

It will be noted that the reactions in both tanks K and L are similar in that primary reaction is accomplished in which glycol is oxidized to sodium or potassium oxalate and there is a reduction of the chromium from the plus 6 level to the plus 3 level, as represented by chromic oxide $Cr_2O_3$. That is, the potassium or sodium dichromates wind up as sodium or potassium oxalates and chromic oxide is formed. When the two solutions are mixed together in vat or tank M to effect the secondary reaction, the chromic oxide appears to act as a catalyst and the mixture of sodium and potassium oxalate is converted to oxalic acid. The full chemical content of the final solution is not definitely known, but its highly effective characteristics as applied to a galvanized surface are known and are recognized as fully meeting the various factors involved in the problem.

I claim:

1. In a method of forming a white rust inhibiting solution for application as a protective film on zinc coated surfaces of a ferrous metal workpiece; preparing a first solution by adding sodium dichromate to ethylene glycol and employing at least a stoichiometric amount of the glycol, reacting them and forming a substantially concentrated aqueous solution; preparing a second solution by adding potassium dichromate to ethylene glycol and employing at least a stoichiometric amount of glycol, reacting them and forming a substantially concentrated aqueous solution; mixing the two solutions in substantially equal proportions from the standpoint of their respective original glycol contents, and diluting the mixed solution with water to provide a practical and effective white rust inhibiting master solution for application to the workpiece.

2. In a method as defined in claim 1, providing a ratio of gram content of sodium dichromate to ml content of the glycol of about 4 to 1 in the first solution, and providing a ratio of gram content of potassium dichromate to ml content of the glycol in the second solution of about 5 to 1.

3. In a method as defined in claim 2, adding water at a raised temperature to each of the first and second solutions and in an amount to assure a complete dissolving of the dissoluble chemical content thereof.

4. In a method as defined in claim 2, adding water at a raised temperature to the first solution in a ratio of about 6 to 1 with respect to the glycol content thereof, and adding water at a raised temperature to the second solution in a ratio of about 9 to 1 with respect to the glycol content thereof.

5. In a method as defined in claim 2, adding water to the first and second solutions before mixing them together and after the introduction of the glycol in each instance, the quantity of water being sufficient to fully dissolve water soluble chemical content of the first and second solutions.

6. In a method as defined in claim 5, adding water to the first solution in a ml ratio of about 6 to 1 with respect to the glycol and in a second solution in a ml ratio of about 9 to 1 ml with respect to the glycol in the second solution.

7. In a method as defined in claim 5 adding water to the first and second solutions at a raised temperature within a range of about 130° to 160°F.

8. In a method as defined in claim 1, adding water to the first and second solution at a temperature of about 130° to 160° F. after the introduction of the glycol thereto, the water being added to each of the first and second solutions in sufficient amount to assure a substantially full saturation of each with respect to the dissoluble chemical content thereof.

9. In a method of forming a white rust inhibiting solution for application as a protective film on zinc coated surfaces of a metal workpiece; preparing a first solution by introducing about 5 ml of ethylene glycol into about 21 grams of sodium dichromate and reacting them, adding about 30 ml of water at a temperature of about 130° to 160° F and forming a substantially concentrated reaction solution containing chromic oxide and sodium oxalate; preparing a second solution by introducing about 5 ml of ethylene glycol into about 25 grams of potassium dichromate and reacting them, adding about 45 ml of water at a temperature of about 130° to 160° F and forming a substantially concentrated solution containing chromic oxide and potassium oxalate; mixing the two solutions in substantially equal proportions and adding about 25 to 75% of water thereto to provide a diluted solution for application as a surface film to the surfaces of a workpiece.

10. In an aqueous clear film-forming master treating solution for application to zinc coated surfaces of a workpiece for preventing formation of white rust thereon in the presence of moisture, said solution comprising a mixture of two preliminary solutions, one of which is a solution in which sodium dichromate is reacted with at least a stoichiometric amount of ethylene glycol to provide chromic oxide and sodium oxalate and containing water in an amount to assure a substantially concentrated solution, the other of which is a solution in which potassium dichromate is reacted with at least a stoichiometric amount of ethylene glycol to produce chromic oxide and potassium oxalate and containing water in an amount to assure a substantially concentrated solution, the two solutions being mixed together on a substantially equal basis from the standpoint of their respective ethylene glycol contents and with water being added to the mixed solution to provide a diluted solution for application to the surfaces of a workpiece.

* * * * *